US008484782B2

(12) United States Patent
Garofalo

(10) Patent No.: US 8,484,782 B2
(45) Date of Patent: Jul. 16, 2013

(54) INFANT BONDING LAP SEAT

(76) Inventor: Anthony Garofalo, Belmar, NJ (US)

( * ) Notice: Subject to any disclaimer, the term of this patent is extended or adjusted under 35 U.S.C. 154(b) by 132 days.

(21) Appl. No.: 13/317,191

(22) Filed: Oct. 13, 2011

(65) Prior Publication Data

US 2013/0091633 A1 Apr. 18, 2013

(51) Int. Cl.
*A47D 13/02* (2006.01)

(52) U.S. Cl.
USPC ..... 5/633; 5/655; 297/250.1

(58) Field of Classification Search
USPC ..... 5/633, 655; 297/250.1; 108/43
See application file for complete search history.

(56) References Cited

U.S. PATENT DOCUMENTS

| | | | | |
|---|---|---|---|---|
| 2,281,629 | A * | 5/1942 | Snow | 5/655 |
| 5,551,109 | A * | 9/1996 | Tingley et al. | 5/655 |
| 6,957,612 | B2 * | 10/2005 | Conlee | 108/43 |
| 6,968,586 | B2 * | 11/2005 | Havenor et al. | 5/655 |
| 7,011,368 | B2 * | 3/2006 | Barth et al. | 297/239 |
| 7,107,639 | B2 * | 9/2006 | Taricani | 5/655 |
| 7,322,063 | B2 * | 1/2008 | Esimai | 5/652.1 |
| 7,997,465 | B2 * | 8/2011 | Garofalo et al. | 224/158 |
| 8,205,285 | B1 * | 6/2012 | Klingemann et al. | 5/655 |

* cited by examiner

*Primary Examiner* — Michael Trettel
(74) *Attorney, Agent, or Firm* — Charles I. Brodsky

(57) ABSTRACT

A lap seat that allows for the comfortable and safe securement of an infant on its cover overlay in resting its inserted base support either forwardly along the upper thigh areas of a caregiver facing the infant, or across the upper thigh areas of the caregiver in facing the infant sideways, as a means of enhancing bonding with the infant while reducing the possibilities of colic and reflux development.

19 Claims, 19 Drawing Sheets

INFANT BONDING LAP SEAT

CROSS-REFERENCE TO RELATED APPLICATIONS

None

STATEMENT REGARDING FEDERALLY SPONSORED RESEARCH OR DEVELOPMENT

Research and development of this invention and application have not been federally sponsored, and no rights are given under any Federal program.

REFERENCE TO A MICROFICHE APPENDIX

Not Applicable

BACKGROUND OF THE INVENTION

1. Field of the Invention

This invention relates to the caring of newborns, in general, and to the enhancement of the bonding with the baby or infant, in particular, effortlessly, comfortably and safely.

2. Description of the Related Art

As is well known, restraints are oftentimes employed in an attempt to hold a young child in a position convenient for its feeding. Similar restraints are also known for use in vehicular transportation in an attempt to protect a child in the event of a rapid deceleration or possible crash of the vehicle. Restraints of these types are also commonly employed in over-and-around the shoulder baby carriers in bringing an adults' child along while walking and shopping and/or in the performance of away-from-home activities. There, in such safe and user-friendly, gentle for baby use and ergonomic manners, designs of a size ranging from newborns up to children 2 years of age and more can easily be found. In fact, in such baby carrying applications, it is oftentimes advertised that the use of such a carrier is a great way to help the infant in transitioning to the world outside. In such ways, from the first few weeks of birth, the infant is heralded as coming to feel secure in adjusting to its new environment.

While restraints may serve their purpose in holding an infant or child in a position convenient for feeding, or for transporting in vehicles, or for providing a freedom of movement, by and large they are not really intended for long periods of use. But, equally as important, those restraints are not intended for use to enhance bonding between the infant and his/her carrier—be it mother or otherwise. What would be desirable for such purpose, on the other hand, would not be something which would be draped around the carry-person's neck, or wrapped around its chest, but something which could be set across one's lap for the infant or child to rest there comfortably, safely and effortlessly in promoting the desirable results of bonding. While breast feeding has been determined to go a long way in establishing bonding between a mother and her infant, something that could be used easily by the infant's father, grandparents, siblings, godparents and just friends would be highly attractive.

SUMMARY OF THE INVENTION

As will become clear from the following description, the present invention provides an infant bonding lap seat with notched channel areas that satisfies these above noted desires. As will be seen, the invention additionally provides such a lap seat which assists in the reduction of colic and reflux in an infant being thusly supported. Furthermore, the teachings described serve to accentuate the bonding that the infant needs and desires—even if only to establish their own self-esteem by feeling loved through the positive, intimate relationship established with those upon whose lap the seat is placed.

BRIEF DESCRIPTION OF THE DRAWINGS

These and other features of the present invention will be more clearly understood from a consideration of the following description, taken in connection with the accompanying Drawings, in which.

DETAILED DESCRIPTION OF THE INVENTION

As has been acknowledged, the most common medical causes of colic are food related. With a breast fed baby or infant, for example, a doctor may suggest eliminating all stimulant foods (e.g. coffee, tea, cola, chocolate, decongestants, diet supplements, etc.) from a mother's diet for a few days to evaluate hoped-for improvements in the baby's condition. For a formula fed infant where a food allergy is suspected, the physician may suggest a hypo-allergenic formula to observe changes in the baby's condition. While these do not correct the condition significantly, the most commonly recommended overall approach then is to use non-medicinal, non-invasive treatments like burping, stomach massage and gas release techniques and emotional support or other rhythmic calming techniques.

In accordance with a first aspect of the present invention, effective results in treating colicky babies results from the lap seat of the invention's inclination of an upward tilt of forward from the vertical, preferably 45° for a total angulation of 135°. Such angulation, according to the invention, has been found to produce a significant improvement in the ability to calm a fussing infant, even with respect to those who suffer with acid reflux.

In accordance with a second aspect of the invention, increased bonding with the caregiver is found to follow from a dimensioning of the infant lap seat so that the angulation places the infant's eyes at a distance of not more than 20 inches from the eyes of the caregiver—and preferably of 12 inches.

Such dimensioning and angulation are provided by the invention whether the infant bonding lap seat is placed so that the infant faces forward towards the caregiver or sideways to the caregiver. This will be seen to be afforded by the provision of slotted sized and spaced channel openings or notched areas about the lap seat to fit the upper thighs of the caregiver. A series of buckles and belts or straps hold the infant safely in the lap seat, and secure the lap seat fast about the waist and back of the caregiver at the same time. In effectuating the foregoing, and as will become clear in the following description, the lap seat of the invention essentially is composed of two parts: a foam base which provides the angulation and spaced openings needed and a cover overlay which receives the foam base and to which the series of belts, straps and buckles are joined.

As will become clear from the following description, this all follows from the design and construction of the foam base which is to be inserted.

Figure 1:
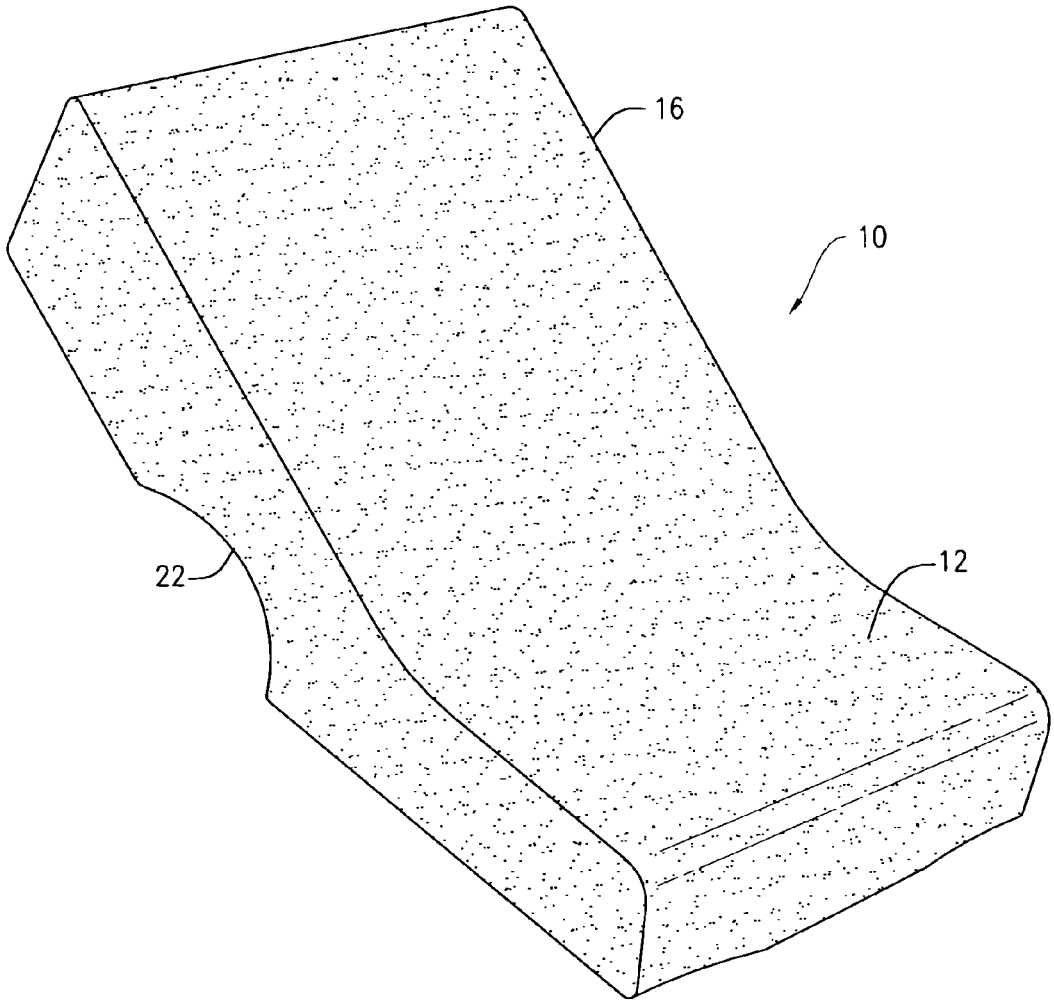
FIG. 1 is a perspective view of the top of a foam or like composition base to be fitted into a cover overlay in forming the infant bonding lap seat of the invention.
Figure 2:
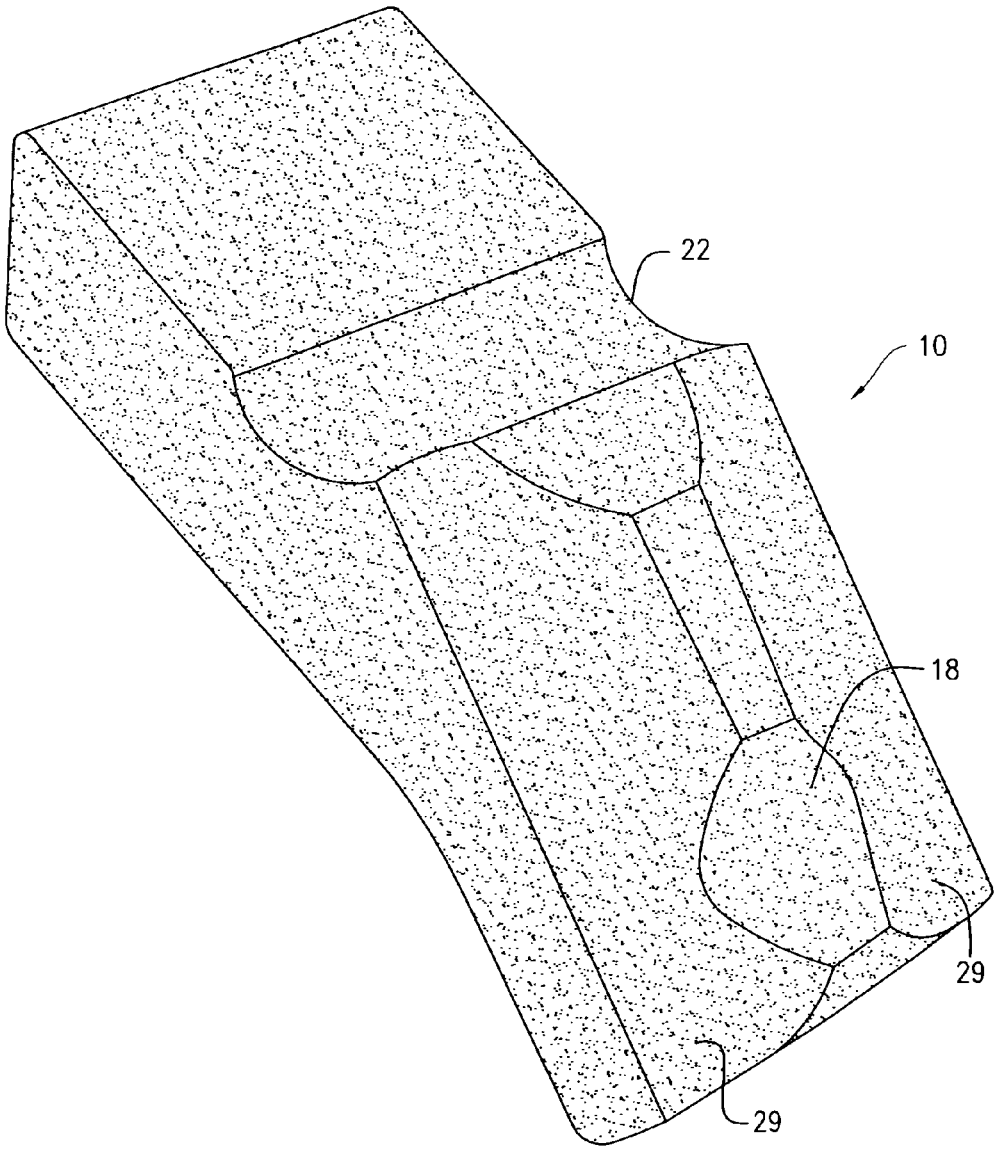
FIG. 2 is a perspective view of the bottom of the base.
Figure 3:
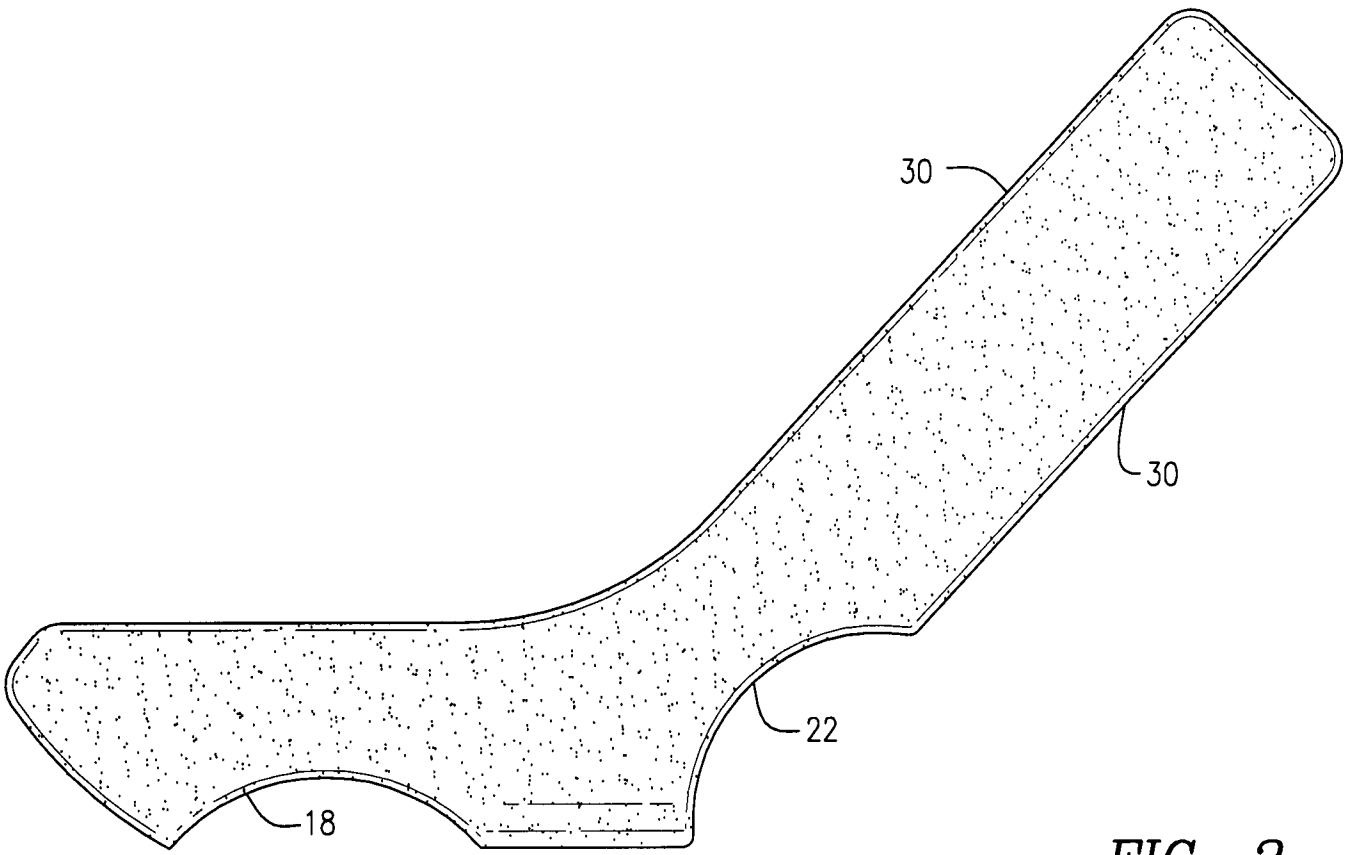
FIGS. 3 and 4 are right and left side views of the foam or like composition base respectively.
Figure 4:
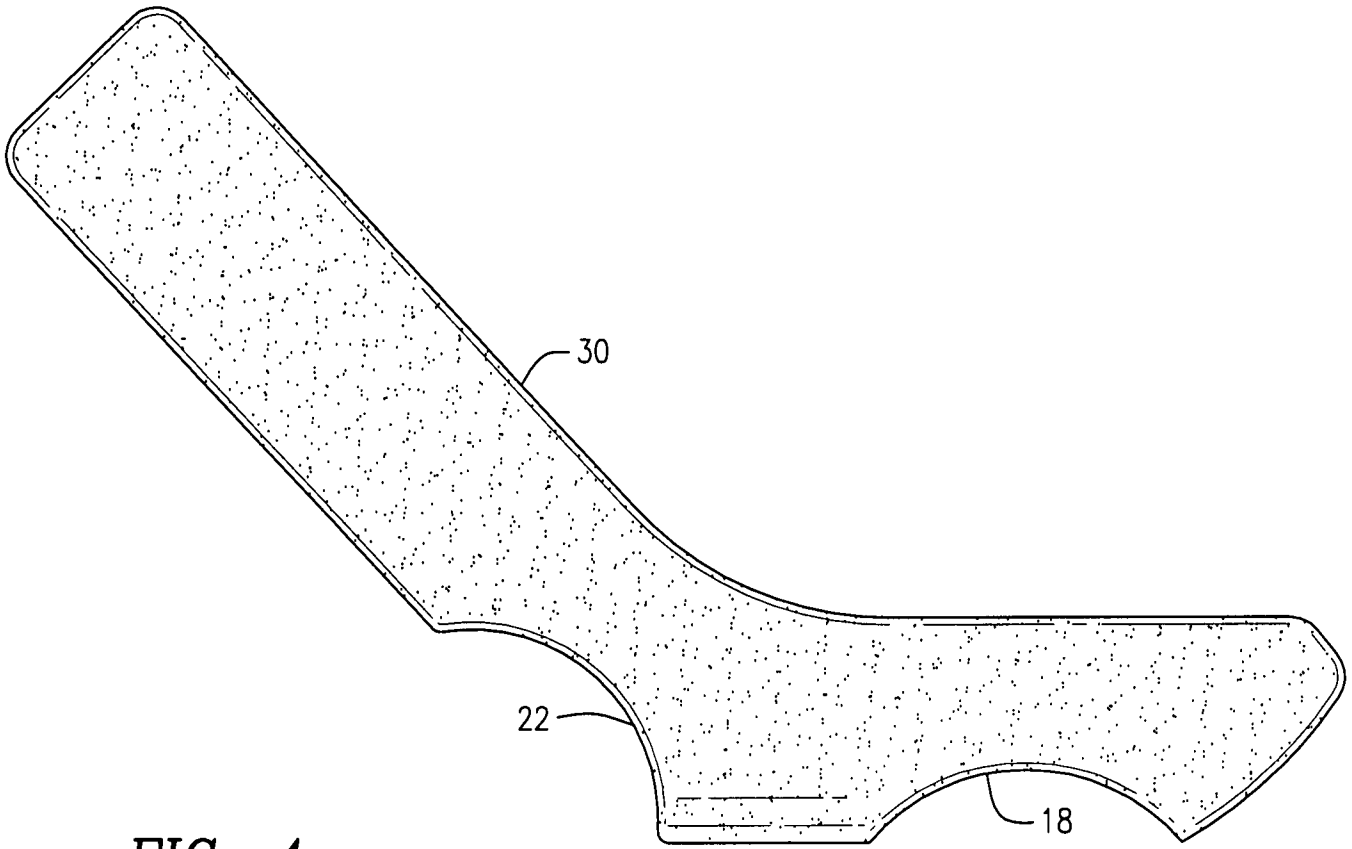
Figure 5:
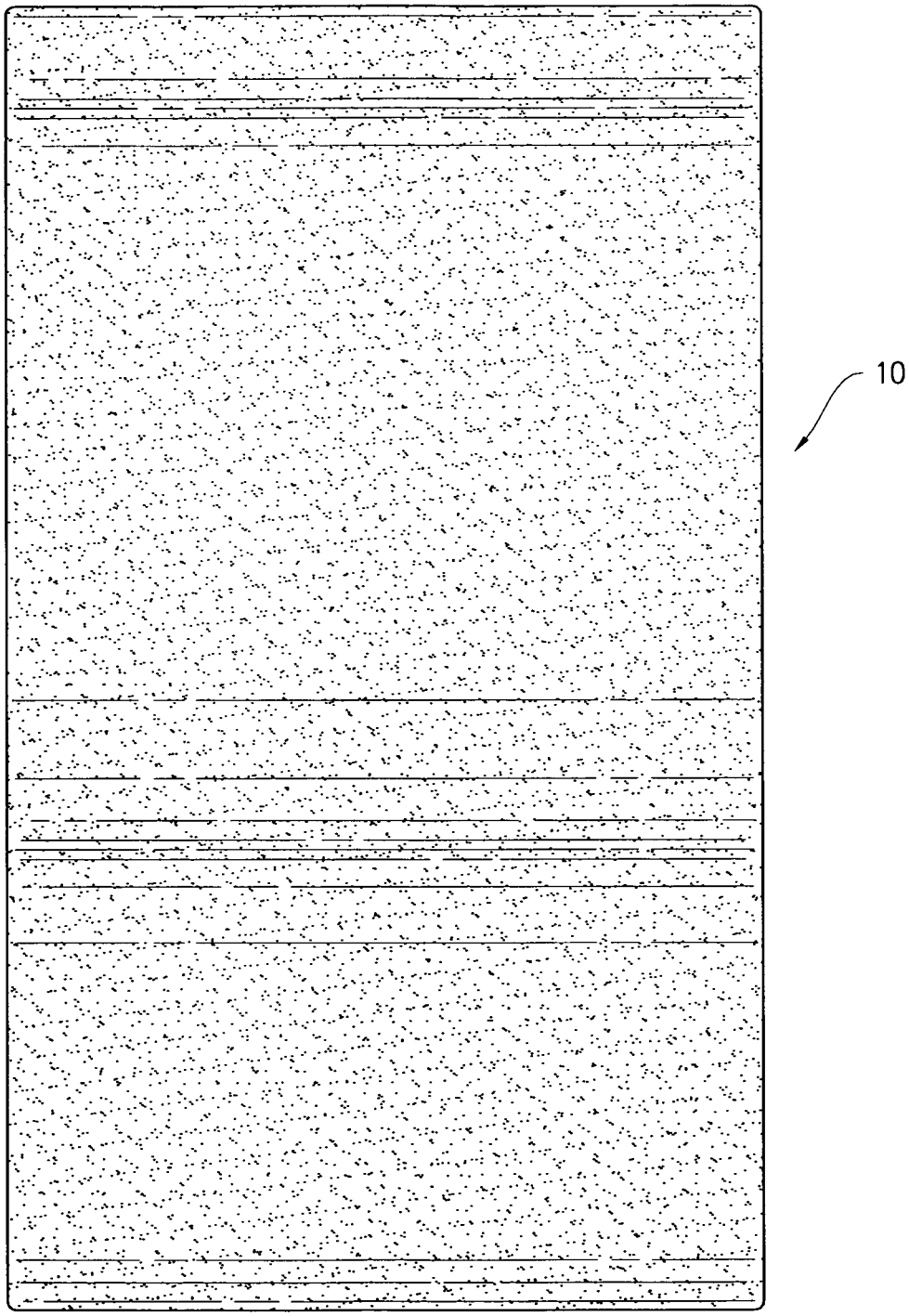
FIG. 5 is top plan view of the base, with lines showing the notched channel areas of the invention.
Figure 6:
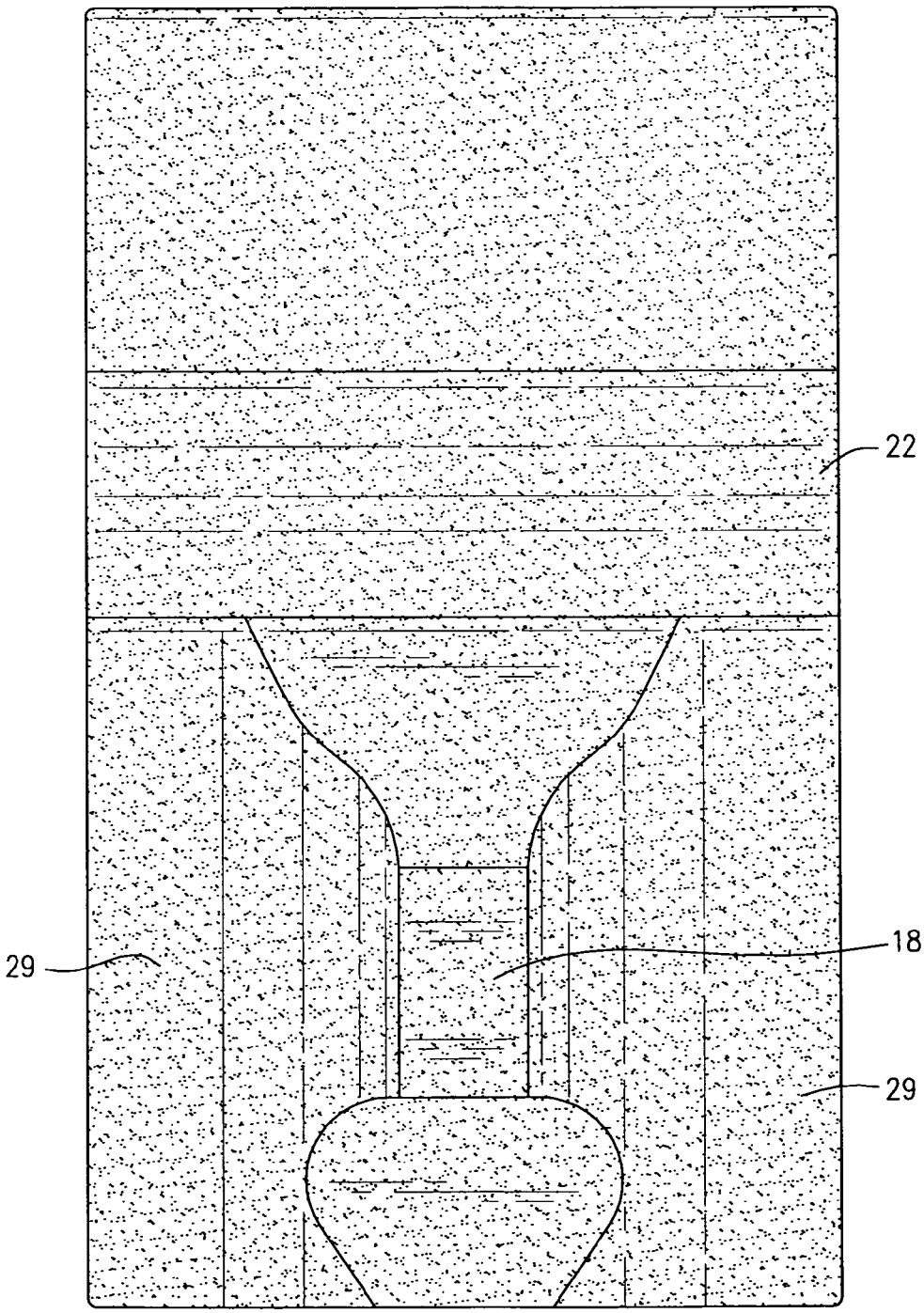
FIG. 6 is a bottom plan view of the base of the lap seat.
Figure 7:
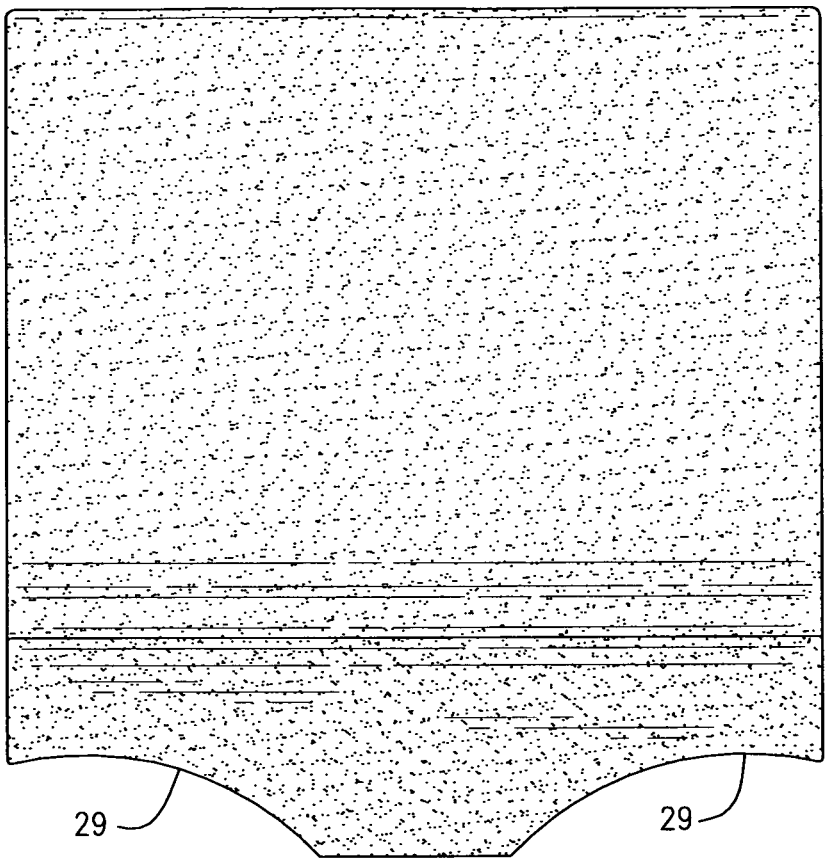
FIGS. 7 and 8 are front and rear elevational views of the lap seat, respectively.
Figure 8:
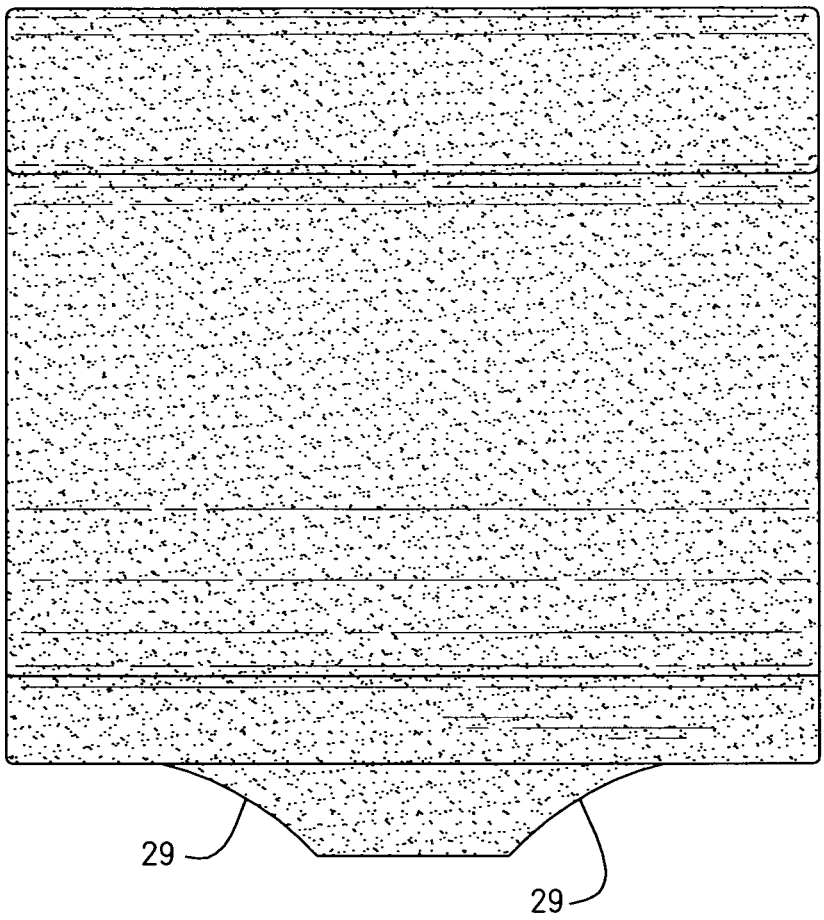
Figure 17A:
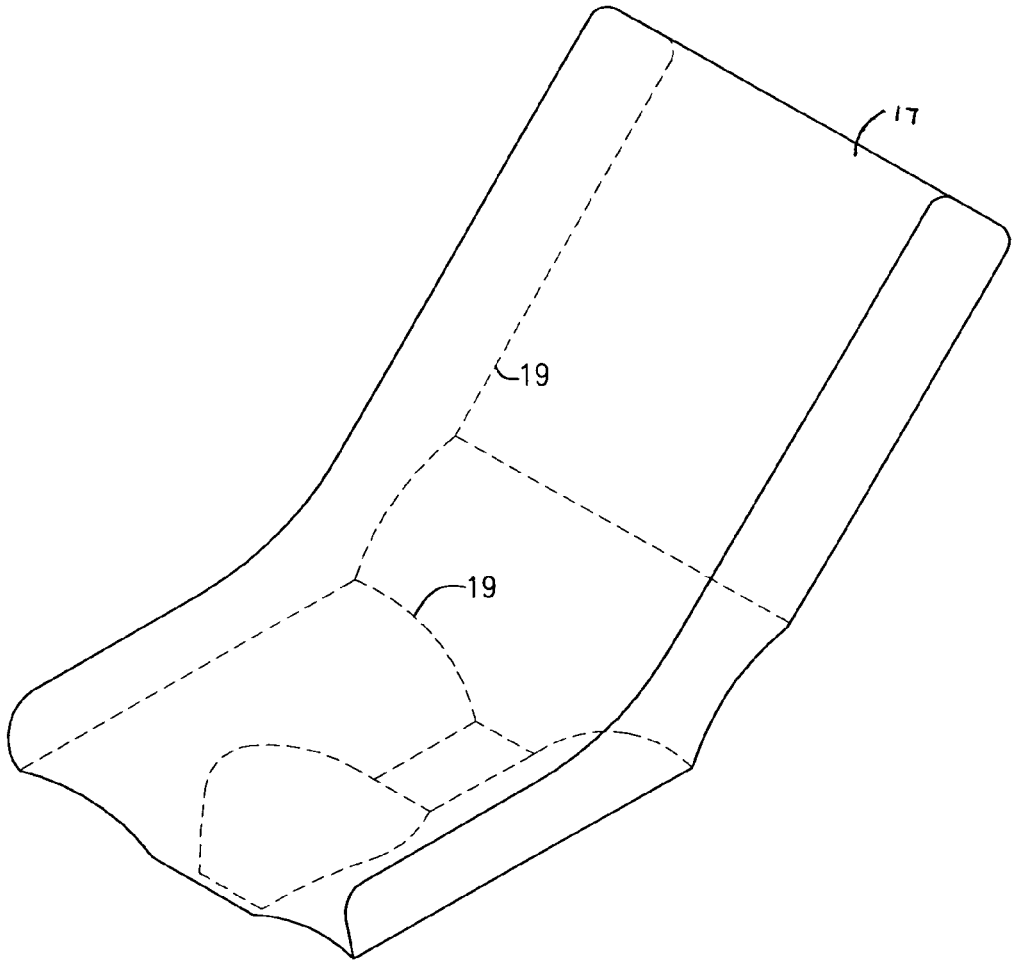
FIGS. 17A-17C are views helpful in an understanding of the dimensioning of the foam or like composition base in providing the optimum support mechanism for the lap seat of the invention.
Figure 17B:
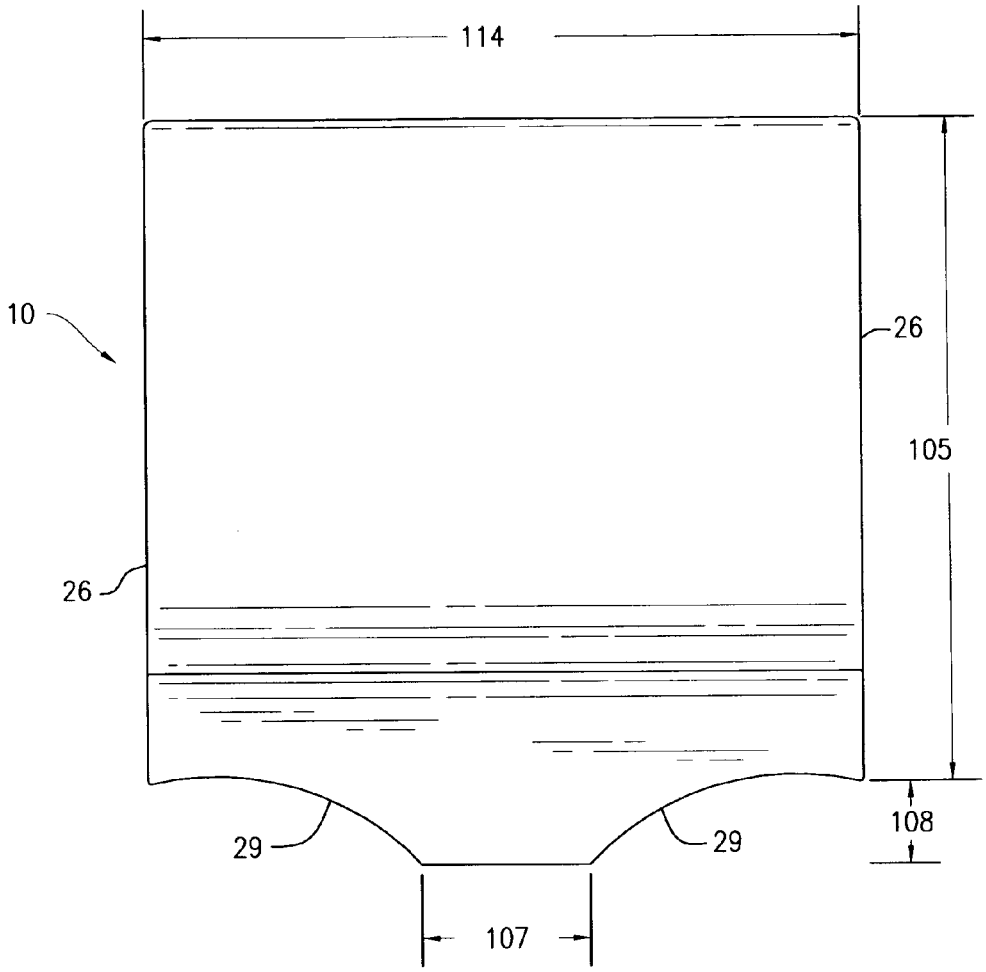
Figure 17C:
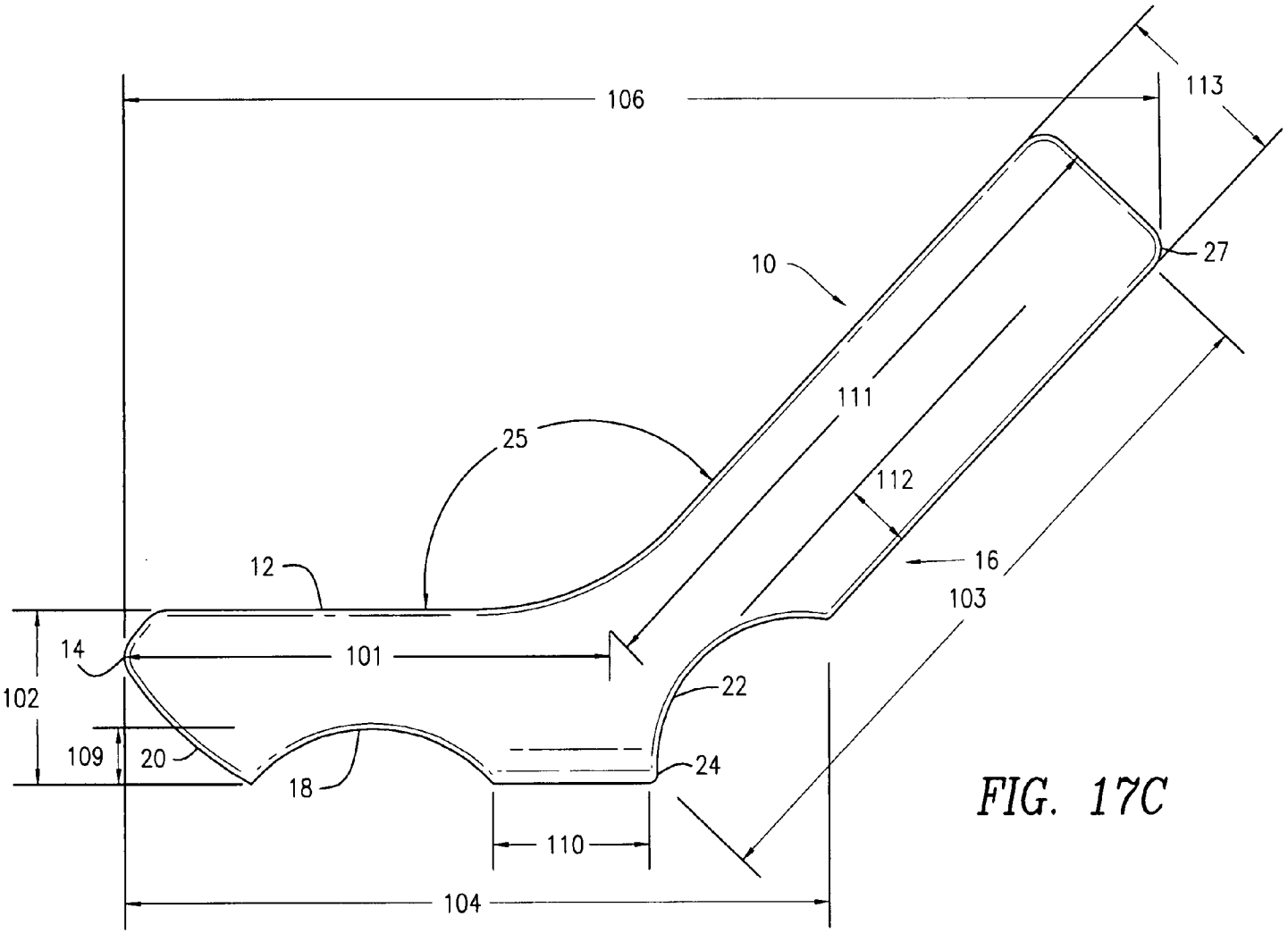

FIG. 1 is a perspective view of the top of the foam or like composition base 10, FIG. 2 is a perspective view of the bottom of the base, and FIG. 5 is a top plan view of the base (as also shown in FIG. 17B), with the left side view of the foam base of FIG. 3 being replicated in FIG. 17C. The cover overlay within which the base 10 is inserted (as in the illustration of FIG. 9) is shown at 17 in the view of FIG. 17A illustrating a top perspective view of the base from the left side, with its underside being shown by the dotted lines 19.

As more specifically shown in FIGS. 17B and 17C, a horizontal section 12 of the base 10 is of a length dimension 101, a vertical width section 14 of the base is of a dimension 102, and a forwardly extended, angulated section 16 of the base is of a length dimension 103. A first notched channel or, curvilinear section 18 extends upwardly adjacent a front 20 of the base 10, while a second notched channel or curvilinear section 22 appears adjacent to a rear 24 of the base 10. The length between the front and rear of the base is shown by the dimension 104, and the height 26 of the base 10 is shown by the dimension 105. Such base 10 could be fabricated, for example, of a polyurethane foam, as employed in a preferred construction of the invention. In accordance with the teachings of the invention, the angle 25 formed between the horizontal section 12 and the forwardly angulated section 16 is preferably some 135° so as to assist in the reduction of acid reflux and in the treatment for colic, although angles of less than or more than 45° forward of the vertical may be selected instead. So as to allow a distance of not more than 20 inches between an infant's eyes and those of the caregiver when the infant is positioned to lie atop the base once the base is inserted into the covered overlay and the infant buckled or strapped in, the dimension 104 is selected less than the dimension 106. Dimension 106 defines the length between the front of the base 20 and the lower end 27 of the angulated section 16.

In accordance with a preferred embodiment of this invention to satisfy its primary objectives with the distance between the infant's and caregiver's eyes of 12 inches, the following dimensions were selected to carry out the teachings of the invention.

Dimension 101 . . . 9.84 inches
Dimension 102 . . . 4.00 inches
Dimension 103 . . . 17.63 inches
Dimension 104 . . . 11.77 inches
Dimension 105 . . . 15.10 inches
Dimension 106 . . . 23.77 inches To assist in the construction and fabrication of the foam or like composition base 10, the following other dimensions were selected, as illustrated in FIGS. 1, 2, 17B and 17C:

Dimension 107 . . . 2.00 inches
Dimension 108 . . . 1.75 inches
Dimension 109 . . . 1.38 inches
Dimension 110 . . . 3.98 inches
Dimension 111 . . . 16.16 inches
Dimension 112 . . . 0.88 inches
Dimension 113 . . . 4.00 inches
Dimension 114 . . . 12.00 inches The arc curvature of the notched channel or curvilinear section 18 is of 3.79 inch radius, the arc curvature of the notched channel or curvilinear section 22 is of 5.31 inch radius, and the arc curvature of the two notched channels or curvilinear sections 29 is of 5.31 inch radius. As will be appreciated, each of the channels 18, 22 and 29 may be of semicircular configuration, with the arc curvature of the channel sections 22 and 29 being substantially equal and greater than the arc curvature of the section 18. As will also be appreciated from the views of FIGS. 17B and 17C, the two channel sections 29 extend from the front of the base 10 towards its back and the channel section 18 and 22 extend within the base 10 from side to side, perpendicular to the channel sections 29.

Figure 9:
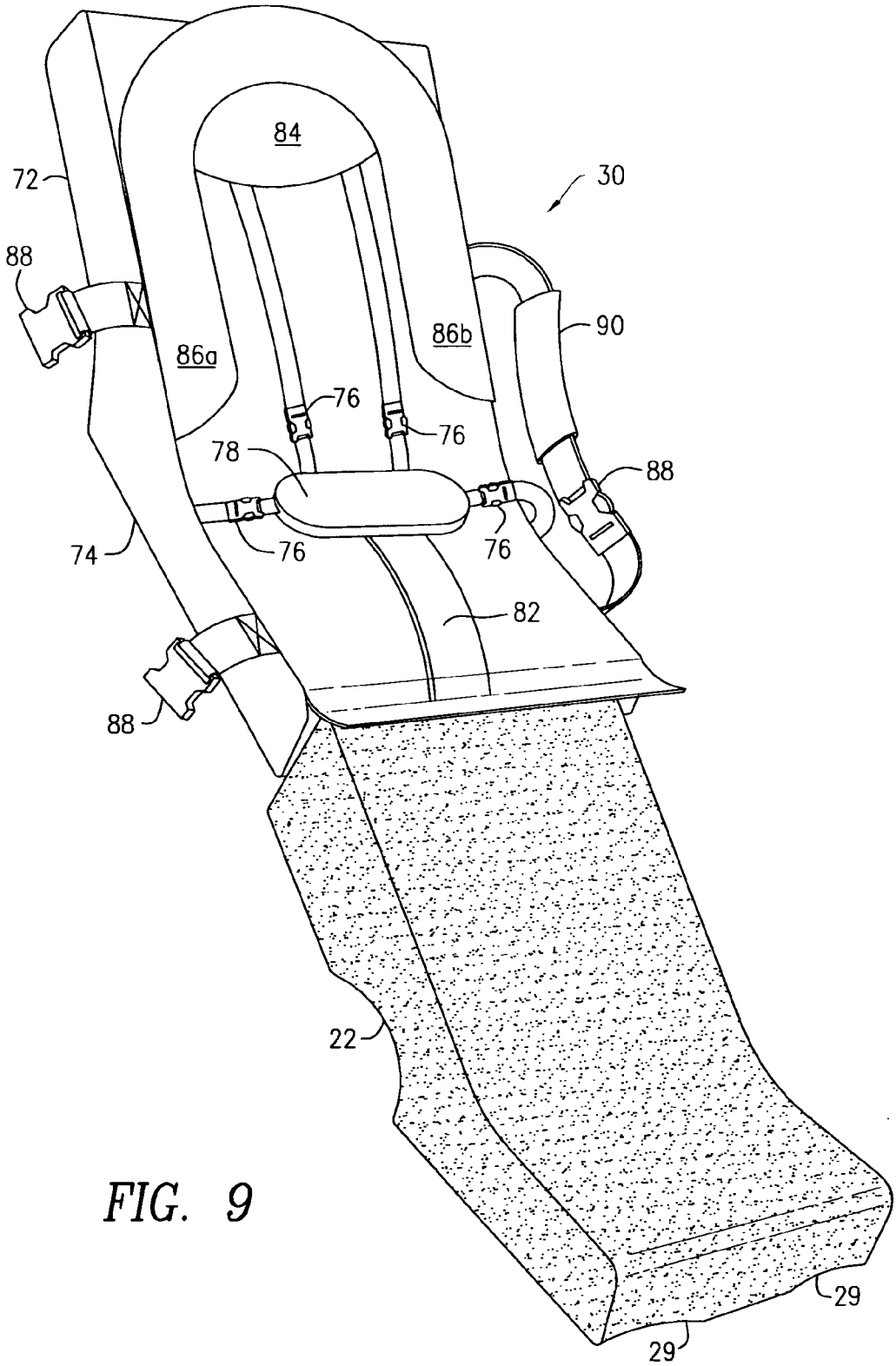
FIG. 9 is an illustration of the foam or like composition base of FIGS. 1-8 as it would be inserted into the cover overlay of the lap seat.
Figure 10:
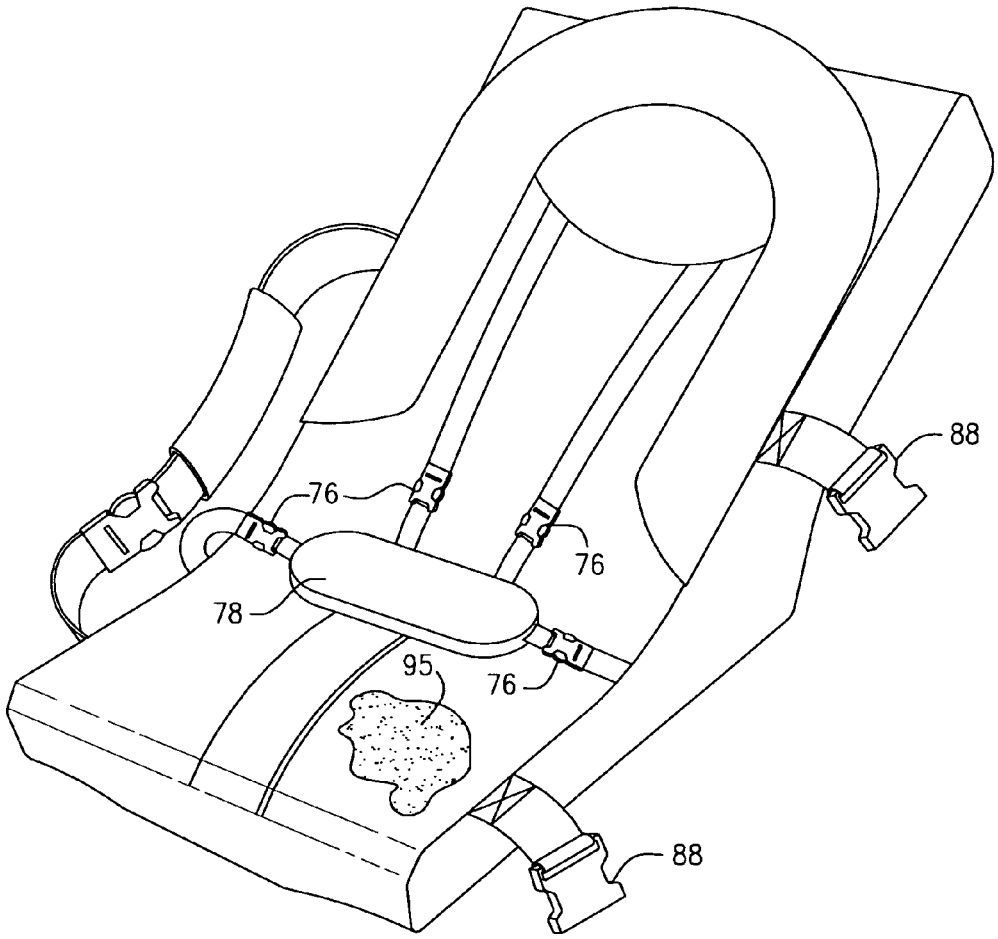
FIG. 10 is an illustration of the infant bonding lap seat of the invention as it would appear with the foam base of FIGS. 1-8 fully inserted.
Figure 11:
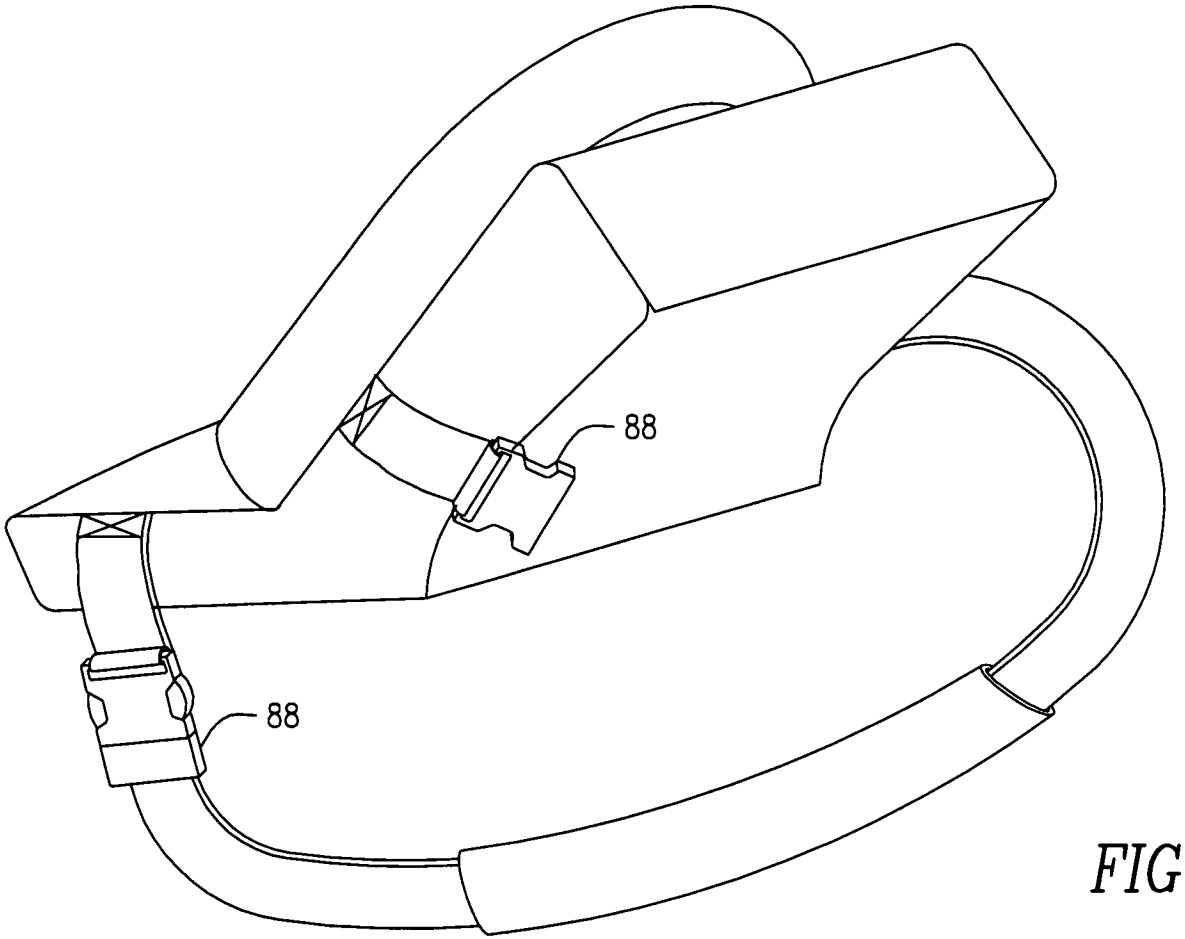
FIGS. 11 and 12 are views helpful in an understanding of a manner of securing the lap seat of the invention for bonding purposes.
Figure 12:
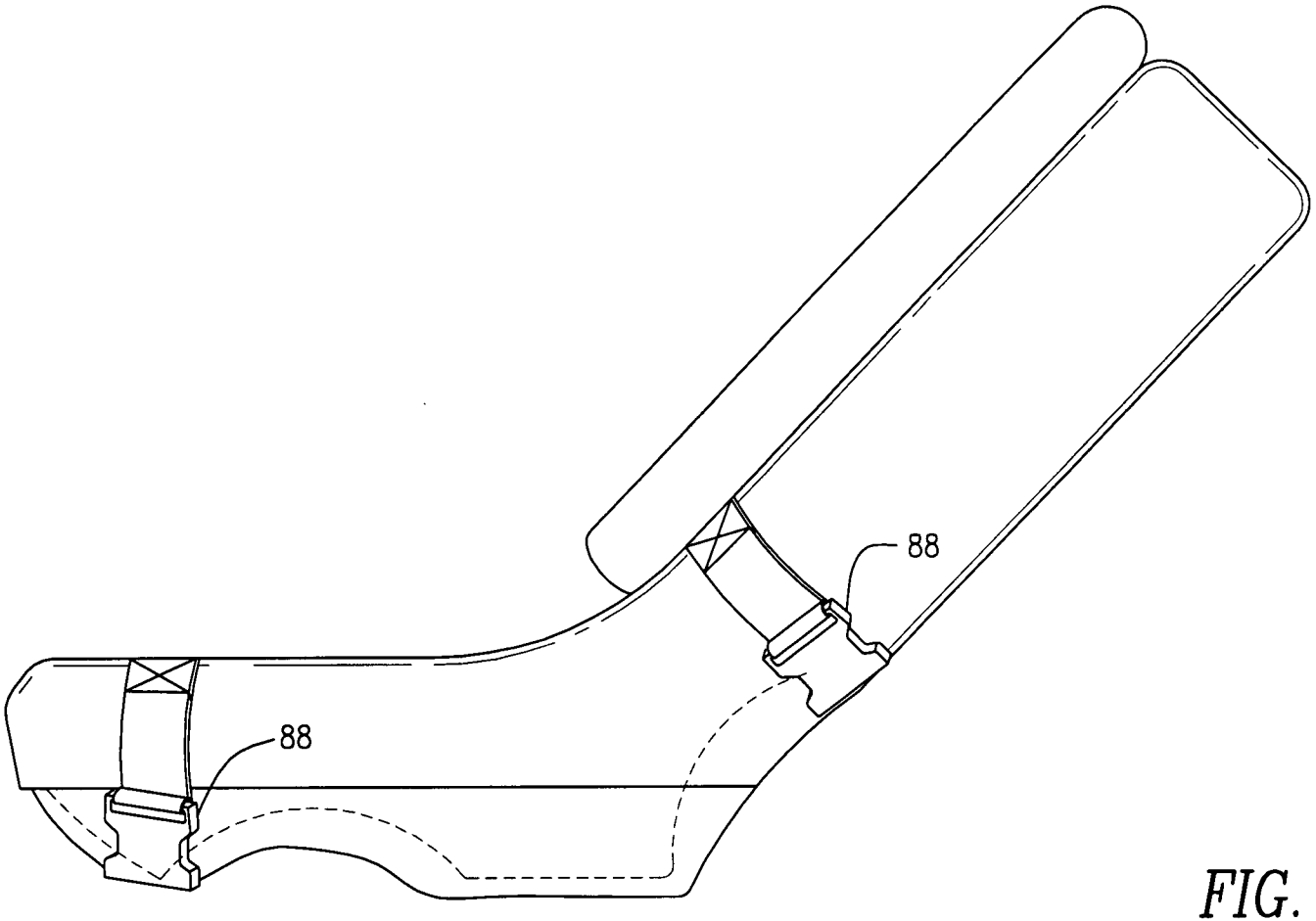
Figure 15:
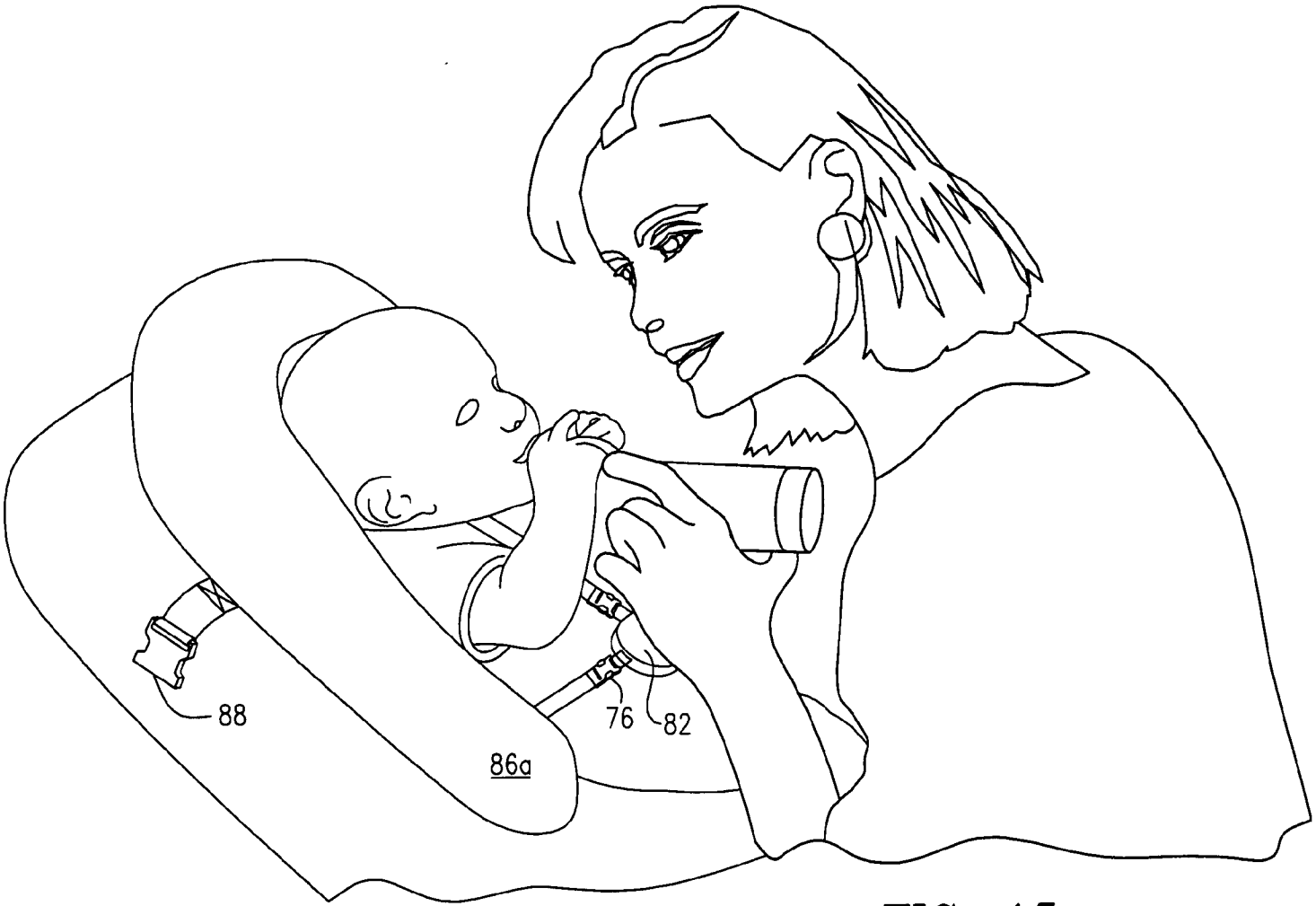
FIGS. 15 and 16 are illustrations helpful in understanding how the lap seat may be utilized by the adult caregiver.
Figure 16:
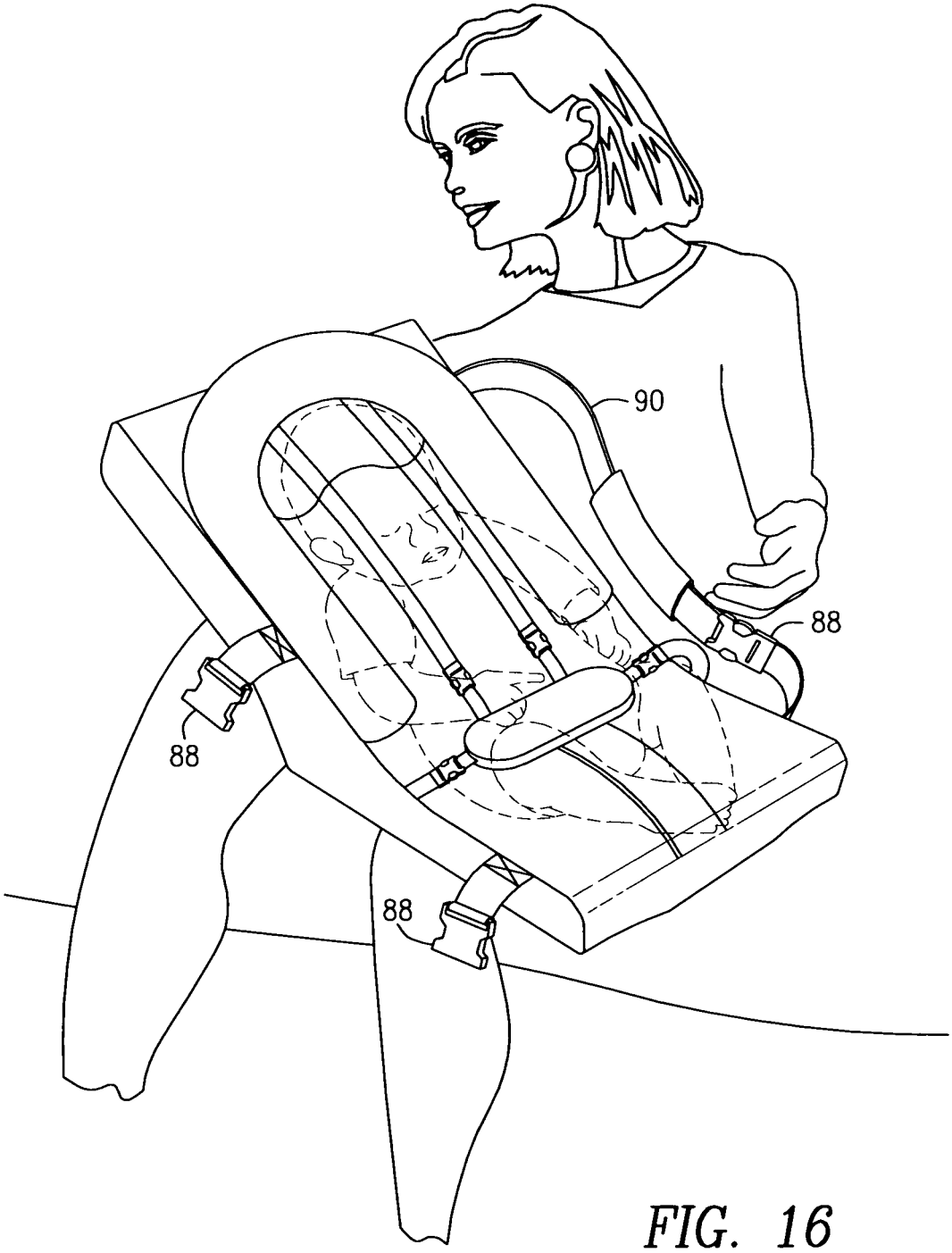

As shown in FIG. 9, the base 10 is inserted into its cover overlay 30 in providing the upward angle slant to the lap seat of the invention. As more clearly seen in the view of FIG. 15, the infant is lain on its back, face up on the cover overlay 30, facing the caregiver, with its upper body resting on the overlay above the angulated section 16 of the base 10 and with its lower body resting on the overlay above the horizontal section 12 of the base 10. As shown in the view of FIG. 16, the lap seat is turned sideways, again with an ability to keep the distance small between the caregiver's and infant's eyes to enhance bonding. (As will be noted, the channel openings 29 in FIG. 15 run along the upper thigh areas of the caregiver, and run across the upper thigh areas in FIG. 16.)

As will be understood, the above dimensions, the angle selections and the arc curvatures of the slotted openings 18, 22 and 29 all allow for the comfortable placement of the lap seat on the upper thigh areas of the supporting caregiver whether placed forwards or sideways in orientation, a resting position for the infant to aid in digestion and resistance to colic and reflux, and an arrangement where the caregiver and infant would face head-on towards one another from a distance of substantially 12 inches.

FIG. 9 shows the cover overlay 30 into which the base 10 of FIGS. 1-8 is inserted. Such overlay—with an open bottom end and a closed top end, and preferably of a polyester composition—includes an upper section 72 upwardly inclined with respect to a lower section 74, with the upper section 72 and the lower section 74 having the same angulation between them as do the angulated section 16 of the base 10 and the horizontal section 12 of the base 10 in FIG. 17C. A 5-point securement is shown in FIGS. 9, 10, 14, 15 and 16 for holding the infant securely on its back when placed on the cover sections 72-74—consisting of four buckle and strap arrangements 76 and a padded section 78 extending from a front of the cover overlay 30 by a strap 82 to which they are sewn. A head rest for the infant is shown at 84, with a bolster of sections 86*a* and 86*b* to hold the infant's head in side-to-side position. As illustrated, the bolster extends upwardly along a first side of the cover overlay, across the closed top end thereof, and downwardly along an opposite second side of the cover overlay.

Figure 13:
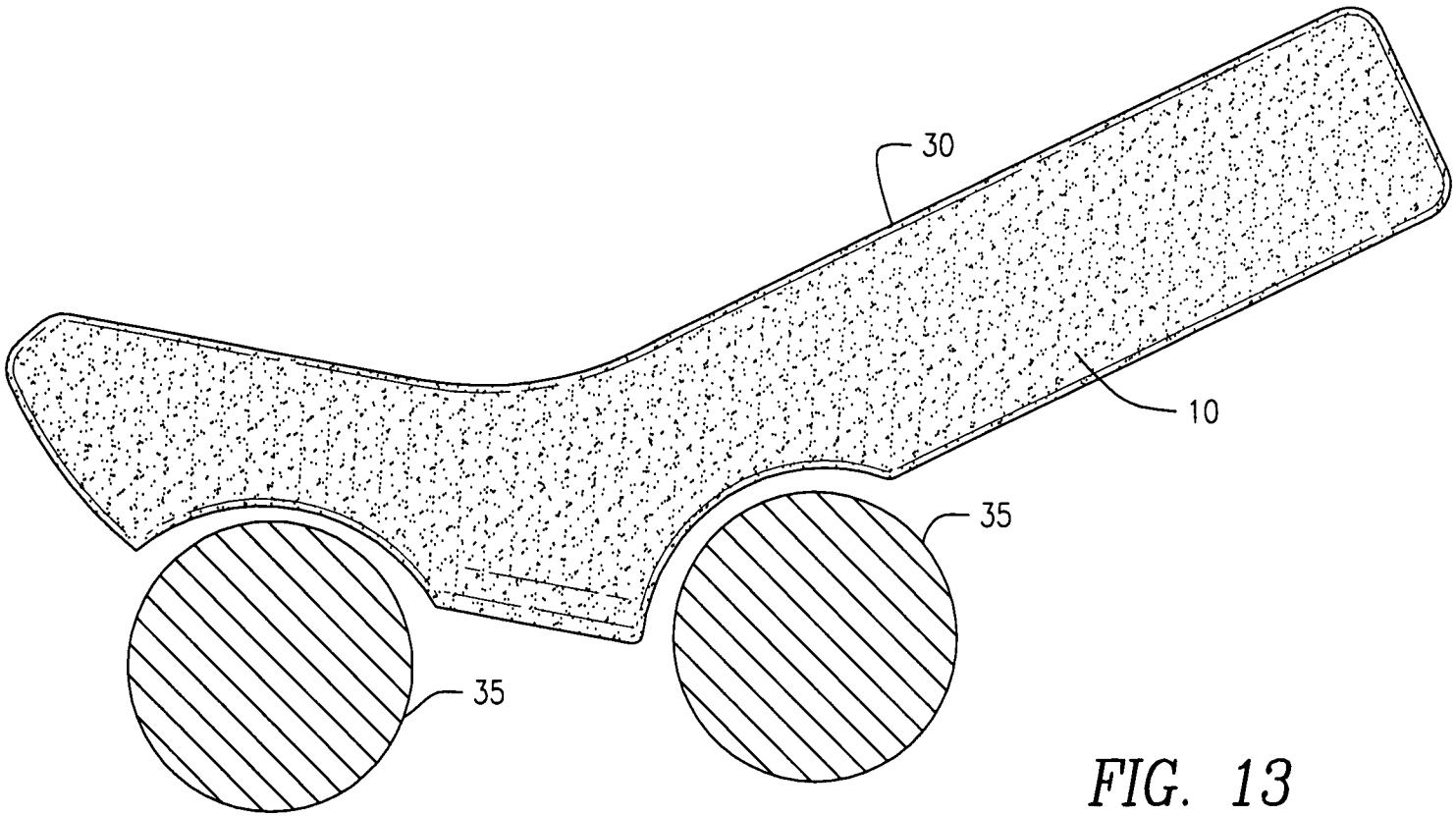
FIGS. 13 and 14 are views helpful in an understanding as to how the foam base and resulting lap seat rests on the upper thigh areas of an adult on whom the infant bonding lap seat rests.
Figure 14:
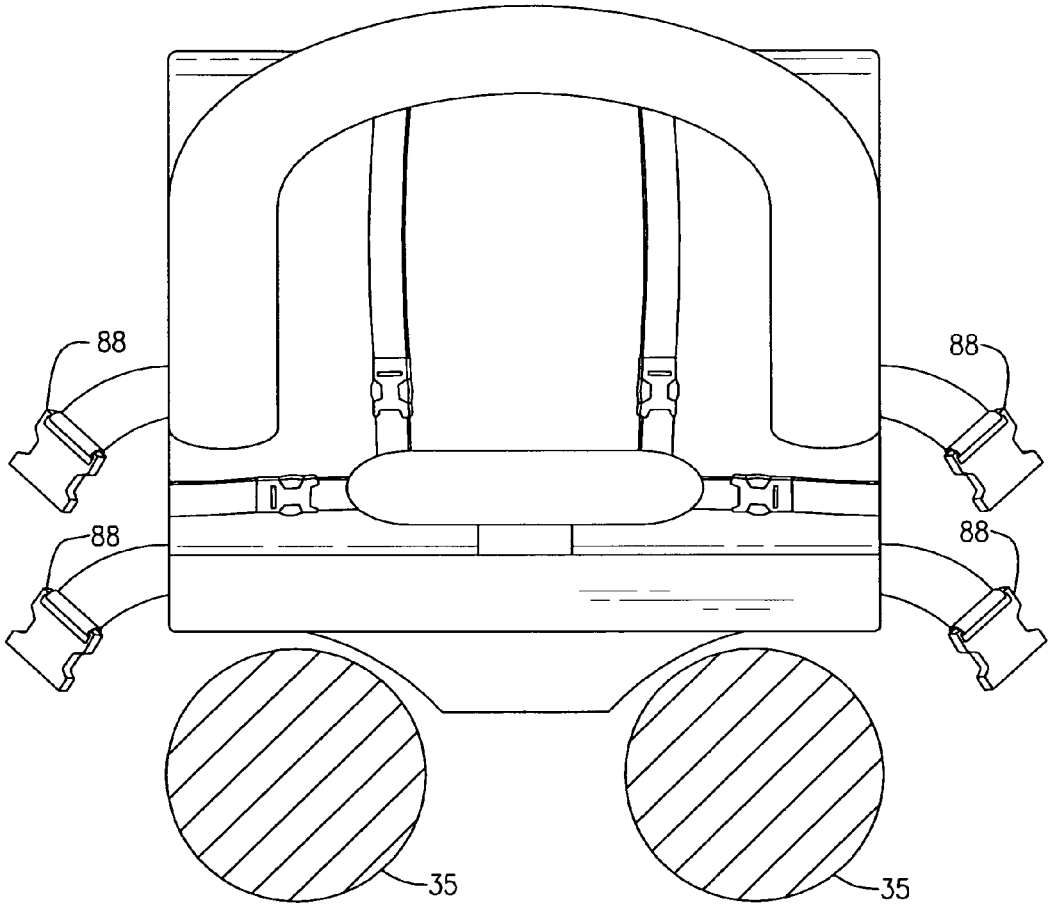

These buckle arrangements are additionally shown in FIGS. 10-12, 14, 15 and 16. A strap 90 is also shown in FIGS. 9, 10, 11 and 16 with its own clasp arrangement to join between the two right side buckles 88 in FIG. 9, or the two left side buckles in FIG. 10, or with the upper right and left side buckles 88 in FIG. 11, or with the two right side buckles 88 of FIG. 16—the strap with its clasp being used to secure the cover overlay and the resultant lap seat. As will be appreciated, such views allow for the wrapping of the strap around the caregiving adult in securing the lap seat to the adult or around a chair on which the lap seat and infant are placed. In any of these configurations, as will be evident, appropriate adjustment can be made to tighten or loosen the strap once in position to begin with. Loosening the four buckles 76 and lifting of the strap 82 allows the infant to be freed from the restraint of the pad 78, or the securement of it once the buckles 76 are clasped in place once again. In these respects, FIG. 13 illustrates the cover overlay 30 and base 10 when the lap seat is lain across the upper thigh areas of the caregiver (FIG. 16) or along the upper thigh areas of the caregiver (FIGS. 14 and 15), the caregiver's legs being represented at 35 in each instance.

In any event, the curvature of the semicircular channel sections 29 of the foam base allow for a comfortable placement of the foam and lap seat on the upper thigh areas of the caregiver when facing the infant on the lap seat, while the curvatures of the sections 18 and 22 allow for comfort when the lap seat is placed sideways on the upper thigh areas. In these manners, the relative size dimensions and selections are each relevant for ease of the placement and the comfort which results. As will also be understood, these produce a lap seat for the resting of an infant on a cushioned top over a supporting bottom, with the top forming upper and lower portions to hold the infant on its back. As will also be seen, the cover overlay has its upper portion being upwardly angled with respect to its lower portion to vertically orient the baby or infant in resting the back of its head on the upper portion of the cushion top and the back of its legs on the lower portion of the cushion top. In corresponding manner, the supporting bottom will be seen to have a plurality of downwardly curved designed notches or channels to provide the comfort of being able to rest the lap seat on the caregiver's lap for extended periods of time. And in this regard, it will be understood that the cover overlay for the base support does not necessarily have to be notched to accept the curved channels as all that is needed is to construct the cover of a material that provides a "give" in allowing the channel shapes to rest on the legs. The cover may then be of a fabric composition, for example, in such manner, draped over the base support inserted within. (The section 95 in FIG. 10 merely indicates the base 10 as being inside the cover overlay for ease of understanding).

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A base within a cover overlay to support an infant lying on its back, comprising:

a first section extending horizontally from front to back;

a second section extending upwardly from the back of said first section at a forward angle with respect thereto;

first and second substantially semicircular channels at an underside of said first section extending from the front thereof towards the back thereof;

a third substantially semicircular channel at an underside of said first section extending from side to side thereof perpendicular to the first and second channels; and a fourth substantially semicircular channel at an underside of said second section extending from side to side thereof perpendicular to the first and second channels; and with an arc radius of said first and second semicircular channels being substantially equal and with an arc radius of said third semicircular channel being less than the arc radius of said first, second and fourth semicircular channels.

2. The base within a cover overlay of claim 1, wherein said second section extends upwardly and forwardly from the back of said first section at an angle of substantially 135°.

3. The base within a cover overlay of claim 2, wherein said first, second and fourth substantially semicircular channels are each of a substantially equal arc radius.

4. The base within a cover overlay of claim 3, wherein said first, second and fourth semicircular channels are each of an arc radius of substantially 5.31 inches.

5. The base within a cover overlay of claim 4, wherein said third substantially semicircular channel is of an arc radius of substantially 3.79 inches.

6. The base within a cover overlay of claim 5, wherein an upper surface of said first section extends horizontally from front to back a distance of substantially 9.84 inches and a lower surface of said first section extends horizontally from front to back a distance of substantially 11.77 inches.

7. The base within a cover overlay of claim 6, wherein an upper surface of said second section extends upwardly from the upper surface of said first section a distance of substantially 16.16 inches and wherein a lower surface of said second section extends upwardly from the lower surface of said first section a distance of substantially 17.63 inches.

8. The base within a cover overlay of claim 7, wherein each of said first and second sections are of a thickness of substantially 4.00 inches.

9. The base within a cover overlay of claim 8, wherein each of said first and second sections of the base are composed of a foam fabrication.

10. A base and cover overlay system to support an infant lying on its base comprising:

a base having a first section extending horizontally from front to back, a second section extending upwardly from the back of said first section at a forward angle with respect thereto, first and second substantially semicircular channels at an underside of said first section extending from the front thereof towards the back thereof, a third substantially semicircular channel at an underside of said first section extending from side to side thereof perpendicular to the first and second channel, a fourth substantially semicircular channel at an underside of said second section extending from side to side thereof perpendicular to the first and second channels, and with an arc radius of said first and second semicircular channels being substantially equal and with an arc radius of said third semicircular channel being less than the arc radius of said first, second and fourth semicircular channels;

and a cover overlay having an open bottom end into which the base is upwardly inserted, a closed top end, and a detachably connectable multi-strap-and-buckle securement extending from an upper surface of said cover overlay to hold an infant in place when laid on said cover overlay.

11. The base and cover overlay system of claim 10, wherein the first, second and fourth semicircular channels of the base are each of a substantially equal arc radius.

12. The base and cover overlay system of claim 11, wherein the second section of the base extends upwardly and forwardly from the back of the first section at an angle of substantially 135°.

13. The base and cover overlay system of claim 12, also including a removable strap, first and second buckle clasps extending from a left side surface of said cover overlay, and third and fourth buckle clasps extending from a right side surface of said cover overlay.

14. The base and cover overlay system of claim 13, wherein the removable strap is adjustable in length to couple either between said first and third buckles or between said second and fourth buckles in securing said base and cover overlay to face said base and cover overlay frontwise towards a caregiver along whose upper thigh areas the base and cover overlay extends via the first and second substantially semicircular channels of the base.

15. The base and cover overlay system of claim 13, wherein the removable strap is adjustable in length to couple either between said first and second buckles or between said third and fourth buckles in securing said base and cover overlay in facing said base and cover overlay sideways towards a caregiver across whose upper thigh areas the base and cover overlay extends via the third and fourth substantially semicircular channels of the base.

16. The base and cover overlay system of claim 14, also including a bolster surrounding the head and upper body of an infant laid on said cover overlay, with the bolster extending upwardly along a first side of the cover overlay, across the closed top end thereof, and downwardly along an opposite second side of the cover overlay.

17. The base and cover overlay system of claim 15, also including a bolster surrounding the head and upper body of an infant laid on said cover overlay, with the bolster extending upwardly along a first side of the cover overlay, across the closed top end thereof, and downwardly along an opposite second side of the cover overlay.

18. The base and cover overlay system of claim 16, wherein the cover overlay includes a cushioned top.

19. The base and cover overlay system of claim 17, wherein the cover overlay includes a cushioned top.

* * * * *